US006526595B2

(12) United States Patent
Held

(10) Patent No.: US 6,526,595 B2
(45) Date of Patent: Mar. 4, 2003

(54) AIR CIRCULATION DEVICE

(76) Inventor: William T. Held, 191 Buffalo Creek Rd., Elma, NY (US) 14057

( * ) Notice: Subject to any disclaimer, the term of this patent is extended or adjusted under 35 U.S.C. 154(b) by 0 days.

(21) Appl. No.: 10/001,093

(22) Filed: Nov. 15, 2001

(65) Prior Publication Data

US 2002/0050000 A1 May 2, 2002

Related U.S. Application Data

(62) Division of application No. 09/519,107, filed on Mar. 6, 2000, now Pat. No. 6,370,697.

(60) Provisional application No. 60/175,944, filed on Jan. 13, 2000.

(51) Int. Cl.[7] ..... A42C 5/04

(52) U.S. Cl. ..... 2/184.5

(58) Field of Search ..... 2/171.3, 184.5, 2/171.4, 209.12, 175.12, 175.6

(56) References Cited

U.S. PATENT DOCUMENTS

| | | | |
|---|---|---|---|
| 1,955,986 | A | 4/1934 | Tice, Jr. |
| 2,398,363 | A | 4/1946 | Donson |
| 3,897,597 | A | 8/1975 | Kasper |
| RE29,452 | E | 10/1977 | Townsend, Jr. |
| 4,274,157 | A | 6/1981 | Boden |
| 4,390,998 | A | 7/1983 | Gallin |
| 4,476,589 | A | 10/1984 | Burgin et al. |
| 4,519,099 | A | 5/1985 | Kamiya et al. |
| 4,539,715 | A | 9/1985 | Clement |
| 4,964,178 | A | 10/1990 | Giancarlo et al. |
| 5,313,668 | A | 5/1994 | Bogan et al. |
| 5,365,607 | A | 11/1994 | Benevento, Jr. et al. |
| 5,481,760 | A | 1/1996 | Wood, Jr. |
| 5,487,191 | A | 1/1996 | Ridley |
| 5,592,936 | A | 1/1997 | Thomas, Jr. et al. |
| 5,625,901 | A | 5/1997 | Healy |
| 5,787,507 | A | 8/1998 | Sullivan |
| 5,867,840 | A | 2/1999 | Hirosawa et al. |
| 5,920,910 | A | 7/1999 | Calvo |
| 6,199,214 | B1 | 3/2001 | Campbell |

FOREIGN PATENT DOCUMENTS

| | | | |
|---|---|---|---|
| GB | 2341784 | A | 3/2000 |

*Primary Examiner*—Bibhu Mohanty
(74) *Attorney, Agent, or Firm*—Hodgson Russ LLP

(57) ABSTRACT

A device for allowing air to circulate is disclosed. An embodiment of the device has a base having an arcuate first side and a second side. The second side has a rib extending from the second side. The device also has a means for attaching the base to a hat. An alternative embodiment of the device is a vent having a first anchoring surface and a second anchoring surface. A truss extends from the first anchoring surface to the second anchoring surface. The devices described above may be used in a hat to allow air circulation. Another embodiment of the present invention is a vented hat having a corrugated head band. Finally, a method making a vented hat is disclosed.

8 Claims, 12 Drawing Sheets

AIR CIRCULATION DEVICE

CROSS CLAIM TO RELATED APPLICATION

Priority is hereby claimed to U.S. Provisional Patent Application No. 60/175,944 filed on Jan. 13, 2000, and is hereby incorporated by this reference. This application is a divisional of Ser. No. 09/519,107 filed Mar. 6, 2000 now U.S. Pat. No. 6,370,697.

BACKGROUND OF THE INVENTION

1. Field of the Invention

The present invention relates generally to devices and methods of allowing air to circulate into and out of a hat.

2. Discussion of Related Art

In the prior art, there are devices for allowing air to circulate into and out of a hat in order to keep the wearer's head cool. One such device includes a flexible open mesh sewn into the hat. Such prior art devices have disadvantages. For example, such devices allow the sun to reach the wearer's head, thereby exposing the wearer to harmful radiation.

SUMMARY OF THE INVENTION

Accordingly, it is an object of the present invention to provide a device and method of allowing air to circulate into and out of a hat.

The foregoing objective is realized by the present invention, which includes a device for allowing air to circulate. The device has a base having an arcuate first side and a second side. The second side has a rib extending from the second side. The device also has a means for attaching the base to a hat.

An alternative embodiment of the device is a vent having a first anchoring surface and a second anchoring surface. A truss extends from the first anchoring surface to the second anchoring surface.

Another embodiment of the present invention is a vented hat having a head band. The head band has a corrugated surface with alternating ridges and grooves oriented to allow air to pass by the head band.

Still another embodiment of the device is a vented hat. The hat has a vent having an arcuate first side, a first anchoring surface, a second anchoring surface, and a truss extending from the first anchoring surface to the second anchoring surface.

In a method according to the present invention, a a hat is provide. The hat has orifice therein. Then, a vent is provided. The vent has an arcuate first side, a first anchoring surface, a second anchoring surface, and a truss extending from the first anchoring surface to the second anchoring surface. Next, the vent is attached to the hat so that the first anchoring surface is on a first side of the orifice and so that the second anchoring surface is on a second side of the orifice.

Other objects and advantages of the present invention will become apparent to those skilled in the art from the following detailed description read in conjunction with the attached drawings and claims appended hereto.

BRIEF DESCRIPTION OF THE DRAWINGS

For a fuller understanding of the nature and objects of the invention, reference should be made to the following detailed description taken in conjunction with the accompanying drawings, in which.

BEST MODE FOR CARRYING OUT THE INVENTION

Figure 2:
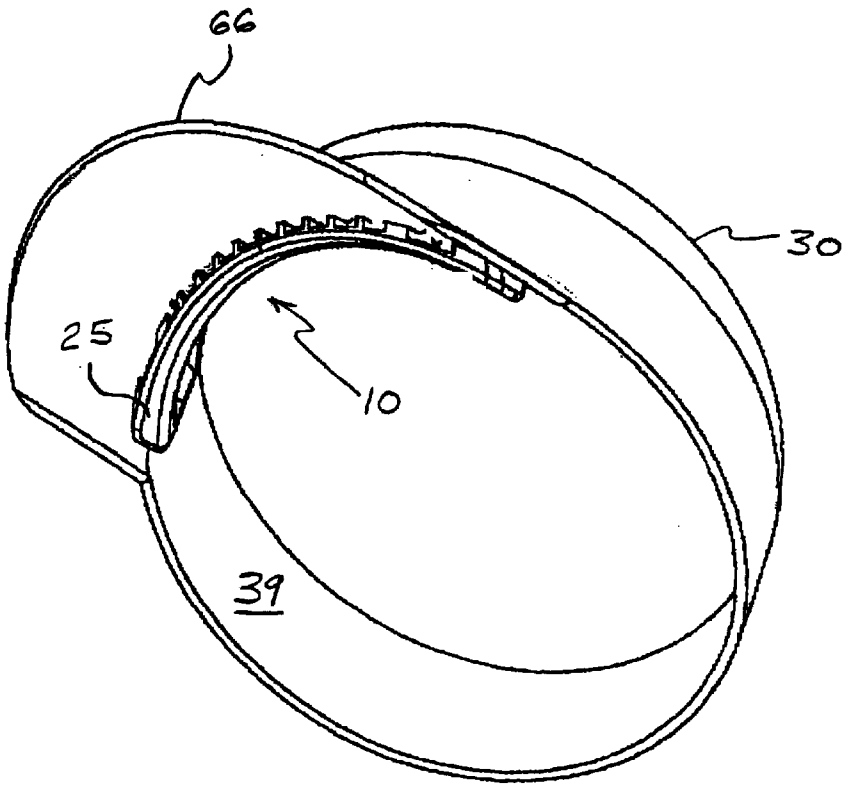
FIGS. 1 and 2 are perspective views of a hat having a device according to the present invention attached thereto.
Figure 1:
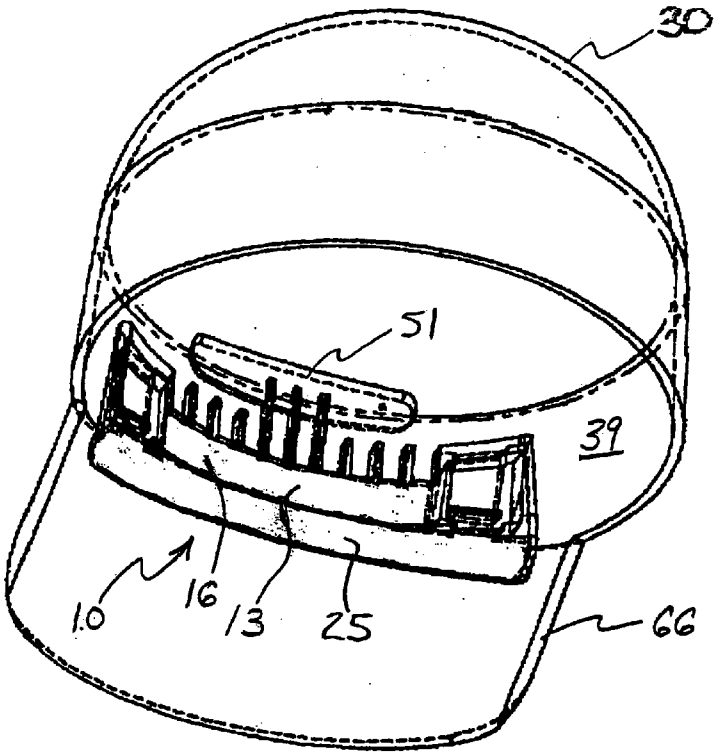
Figure 3:
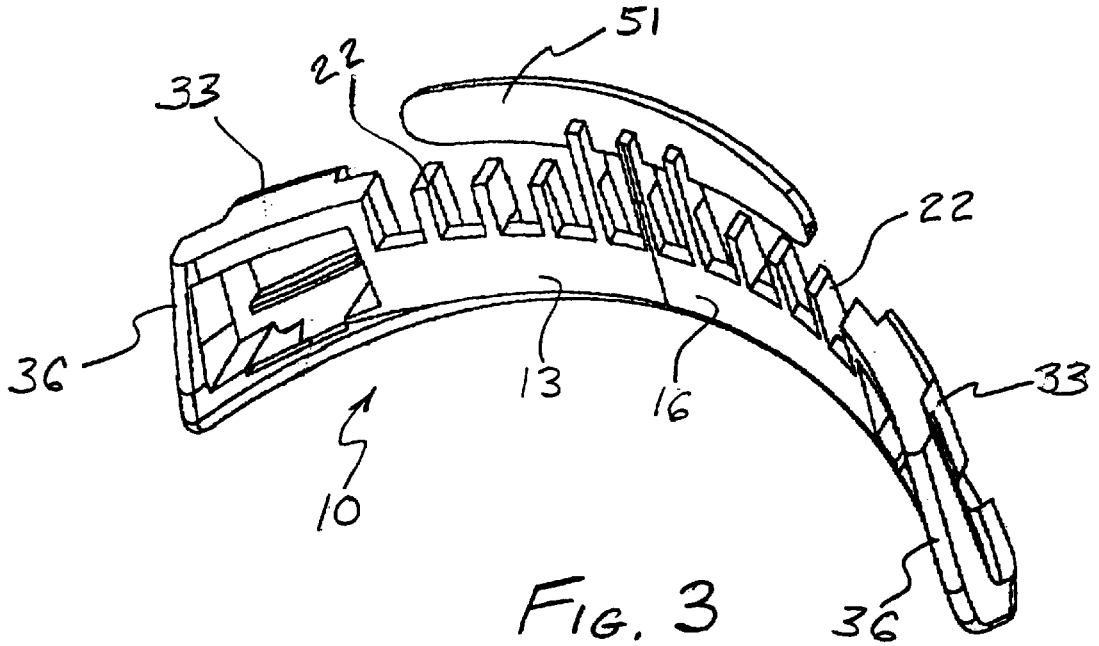
FIGS. 3 and 4 are perspective views of the device shown in FIGS. 1 and 2.
Figure 4:
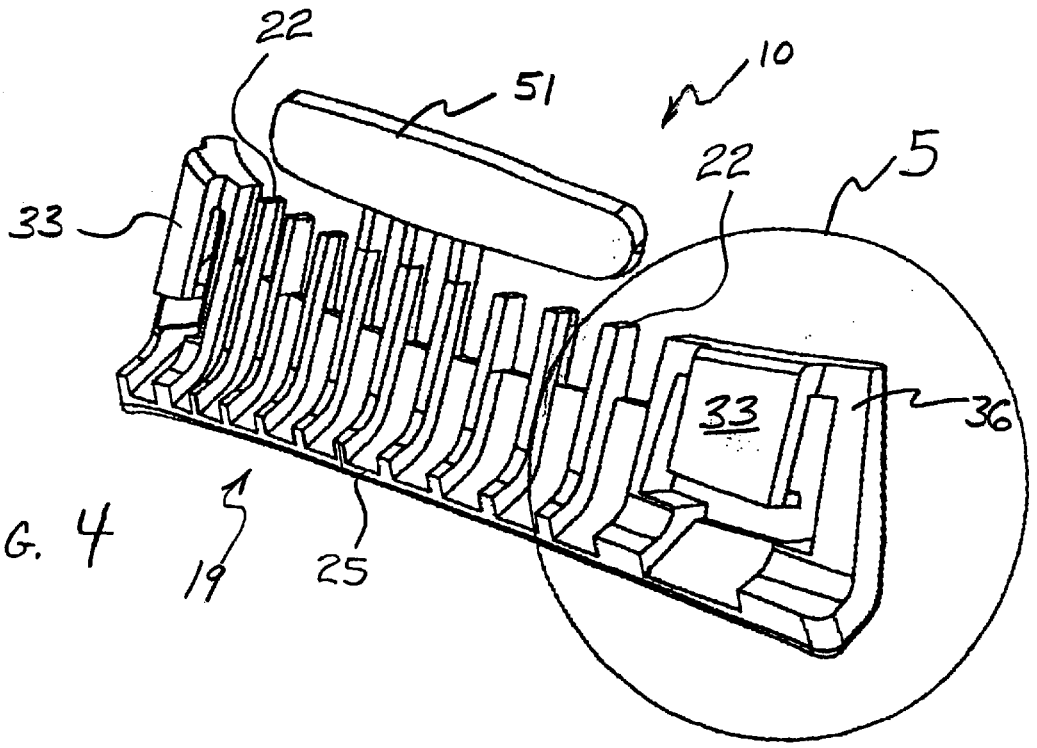
Figure 5:
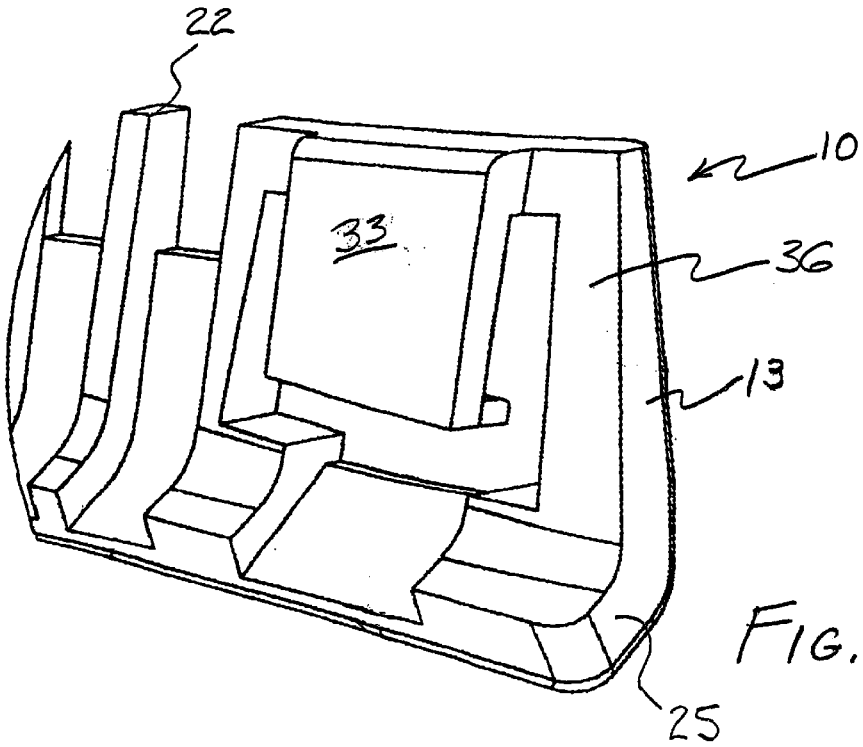
FIG. 5 is an enlarged perspective view of the area indicated as "5" in FIG. 4.
Figure 6:
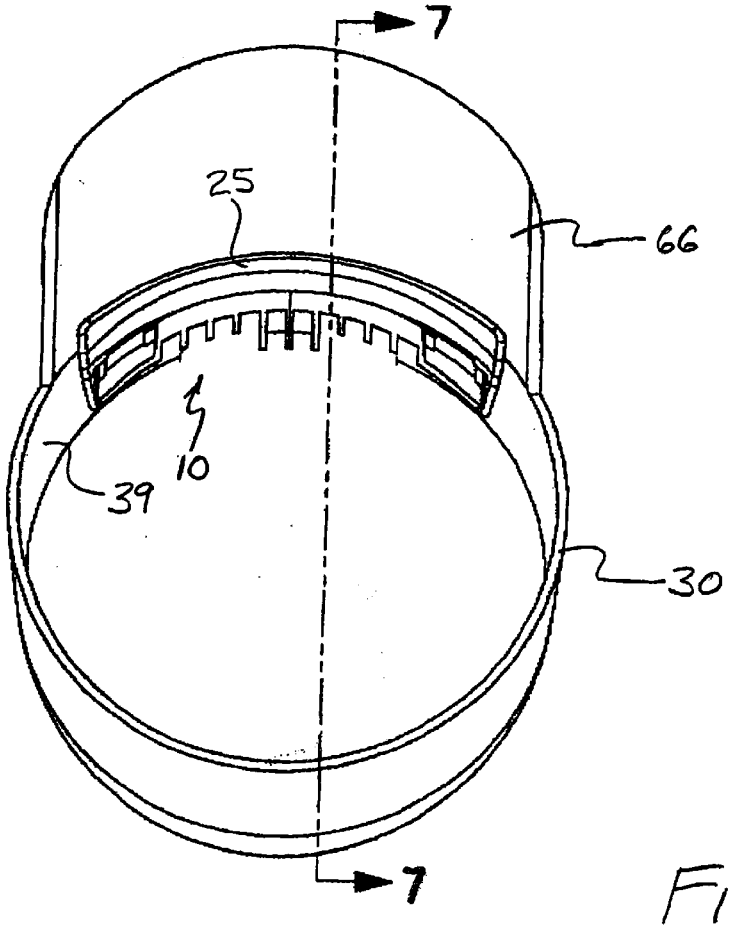
FIG. 6 is another perspective view of the hat and device shown in FIGS. 1 and 2.
Figure 7:
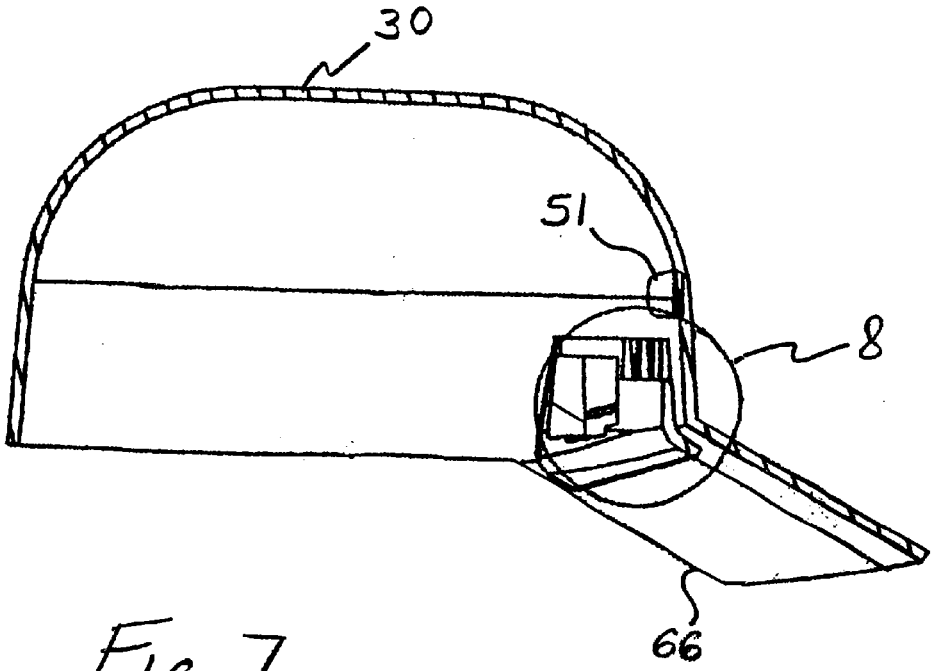
FIG. 7 is a cross sectional view of the hat and device shown in FIG. 6 taken along the line 7—7 in FIG. 6.
Figure 8:
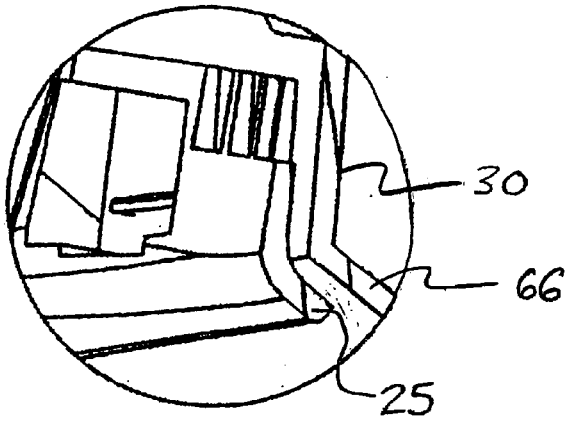
FIG. 8 is an enlarged view of the area indicated as "8" in FIG. 7.
Figure 9:
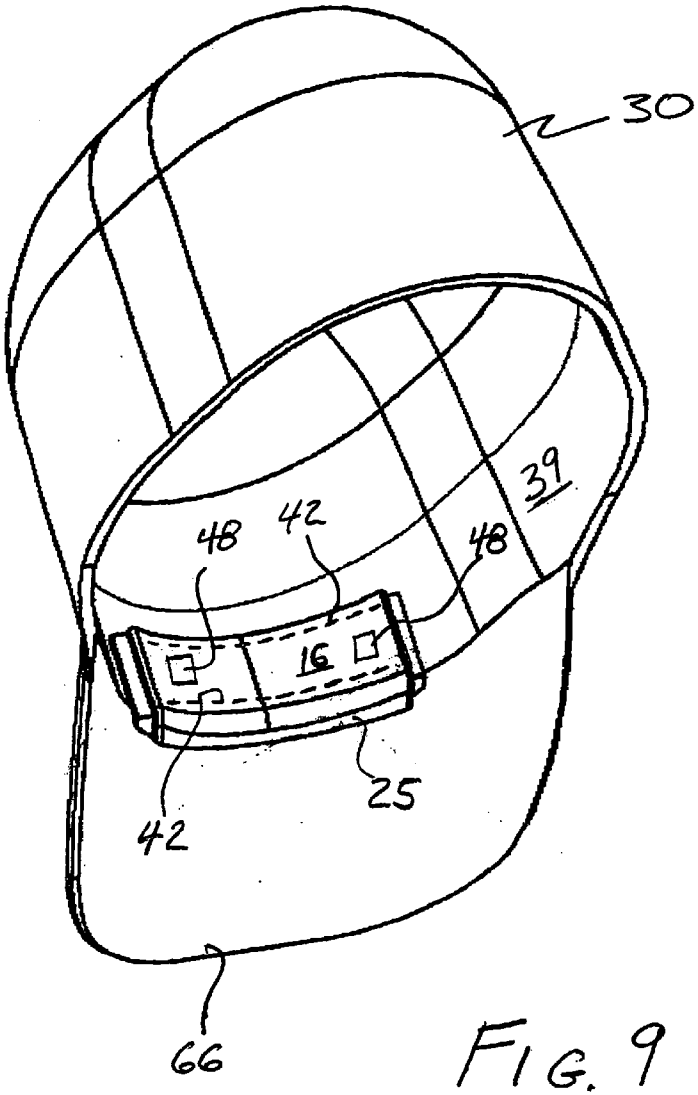
FIGS. 9 and 10 are perspective views of an alternative embodiment of the present invention.
Figure 10:
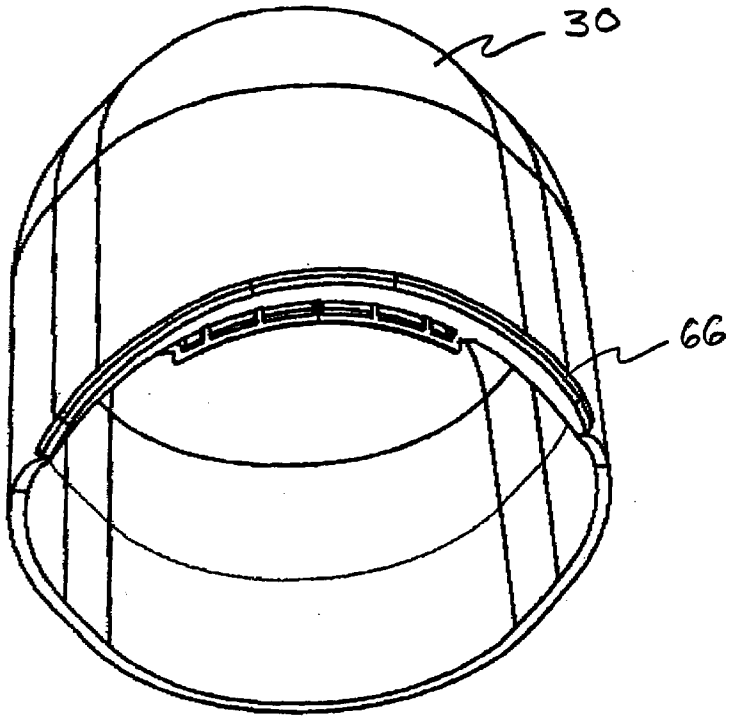
Figure 12:
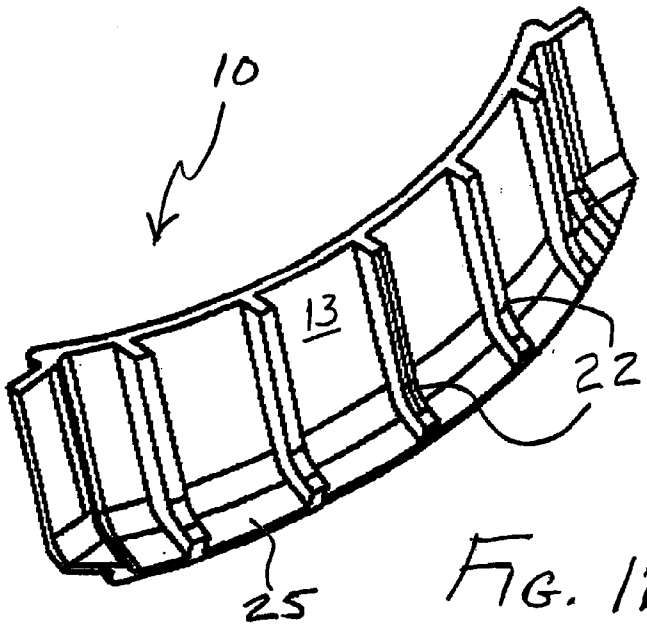
FIGS. 11 and 12 are perspective views of the device shown in FIGS. 9 and 10.
Figure 11:
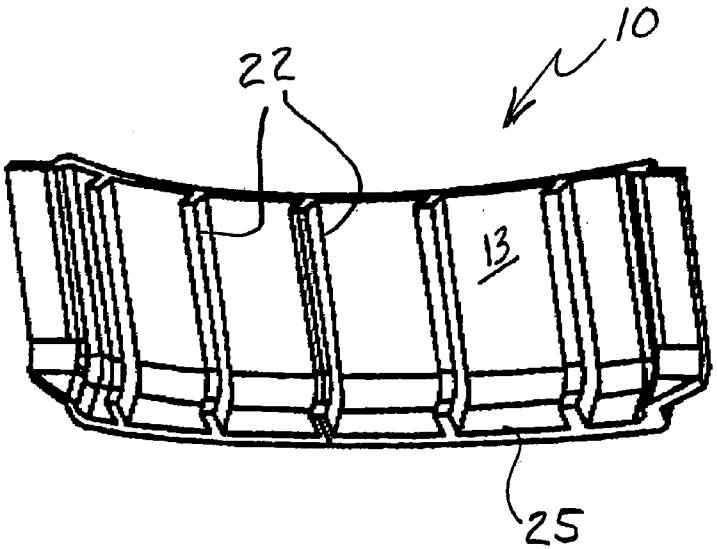

FIGS. 1–8 show a device 10 according to the present invention. The device 10 includes a base 13 having an arcuate first side 16 and a second side 19. The second side 19 has a rib 22 extending from the second side 19. The base 13 preferably has a lip 25 extending away from the arcuate first side 16.

The device 10 also includes a means for attaching the base 13 to a hat 30. The means for attaching the base 13 may include one or more clips 33. Furthermore, the base 13 may include a bracket 36 from which a clip 33 extends. The clips 33 permit the device 10 to be selectively attached to a head band 39 in the hat 30.

FIGS. 9–12 show an alternative embodiment of the present invention. Features similar to those described above have the same feature number. The means for attaching shown in FIG. 9 includes thread 42 sewn through the device 10 and the hat 30. As such, the device 10 is not easily removed from the hat 30. The devices 10 shown in FIGS. 1–12 may also use an adhesive to hold the device 10 to the hat 30.

Figure 13:
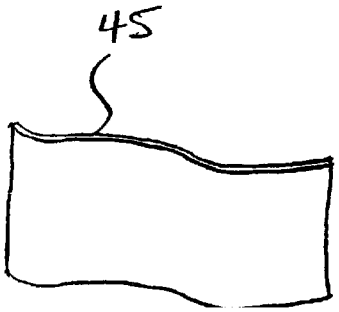
FIG. 13 is a perspective view of an absorbent material according to the present invention.
Figure 16:
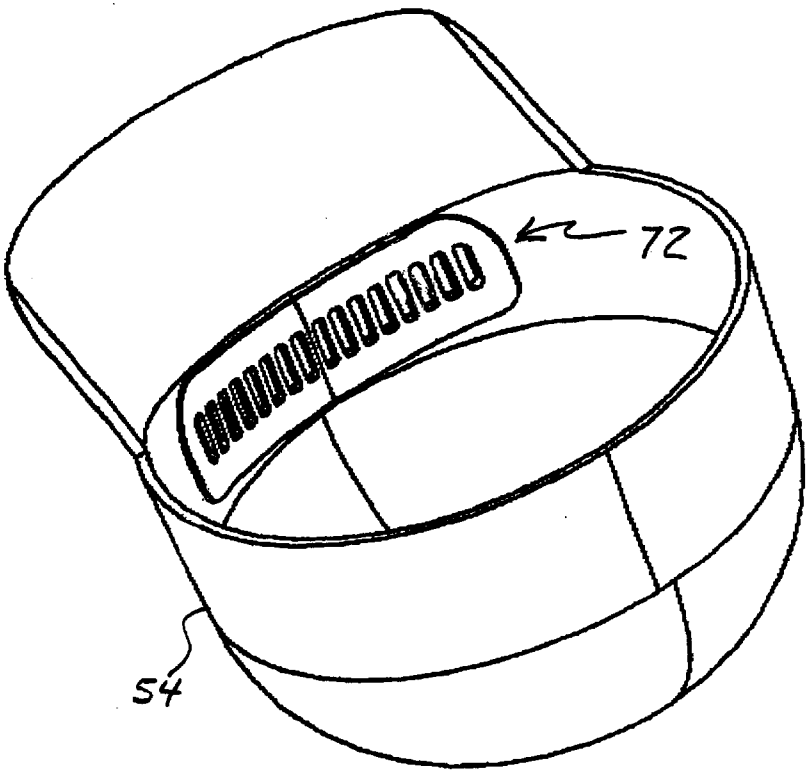
FIGS. 15 and 16 are perspective views of a vented hat according to the present invention.
Figure 15:
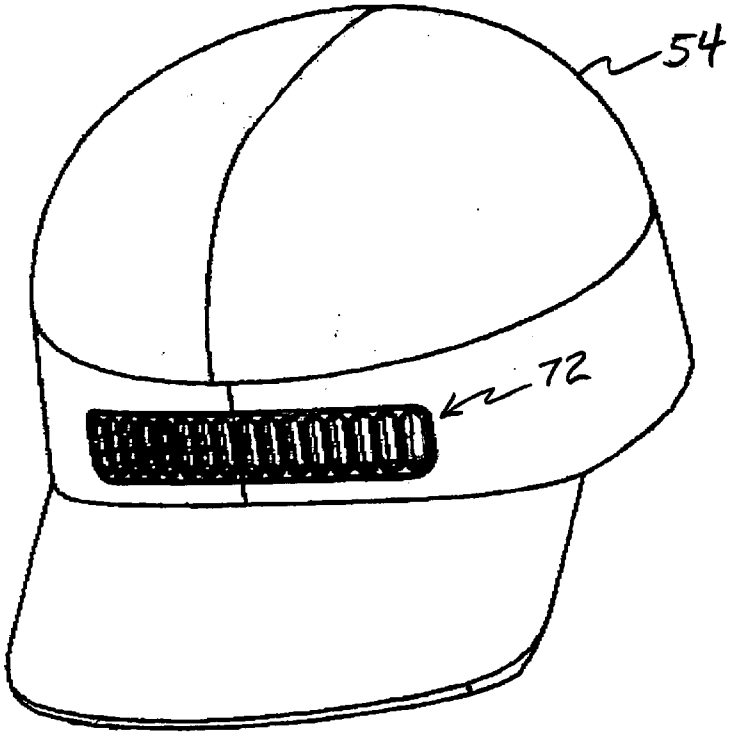
Figure 17:
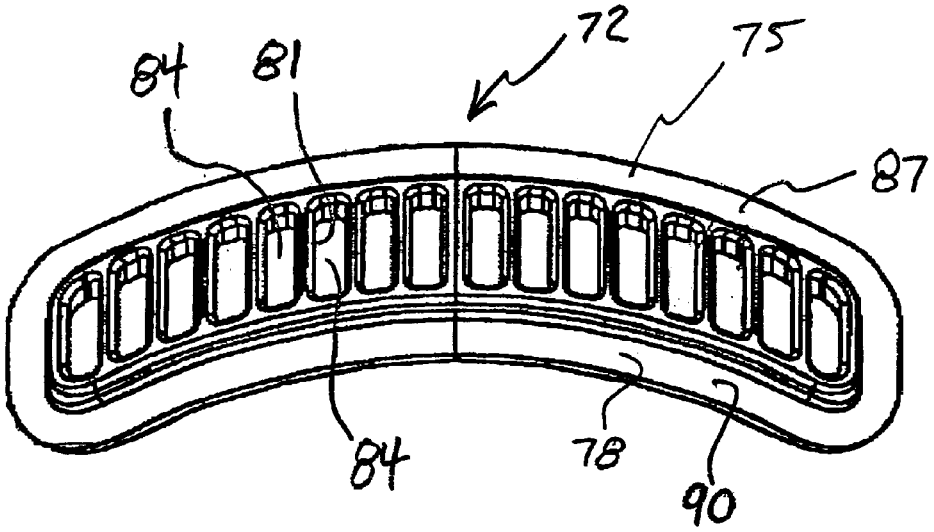
FIGS. 17–20 are perspective views of the vent shown in FIGS. 15 and 16.
Figure 18:
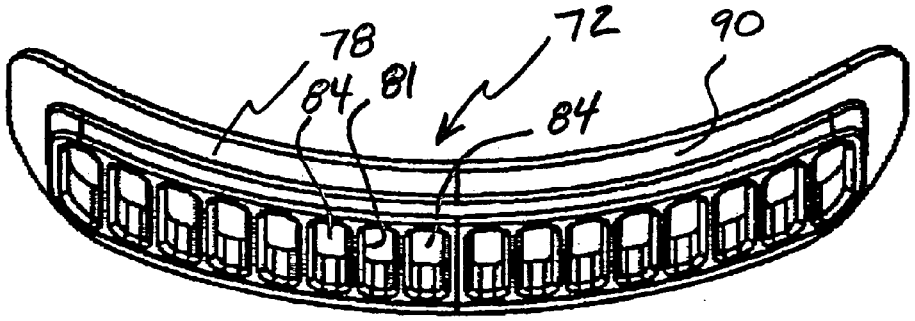
Figure 19:
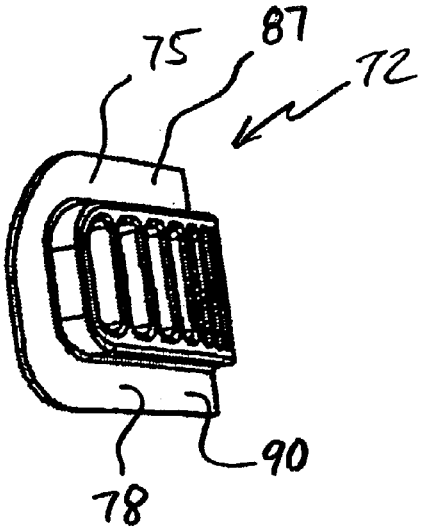
Figure 20:
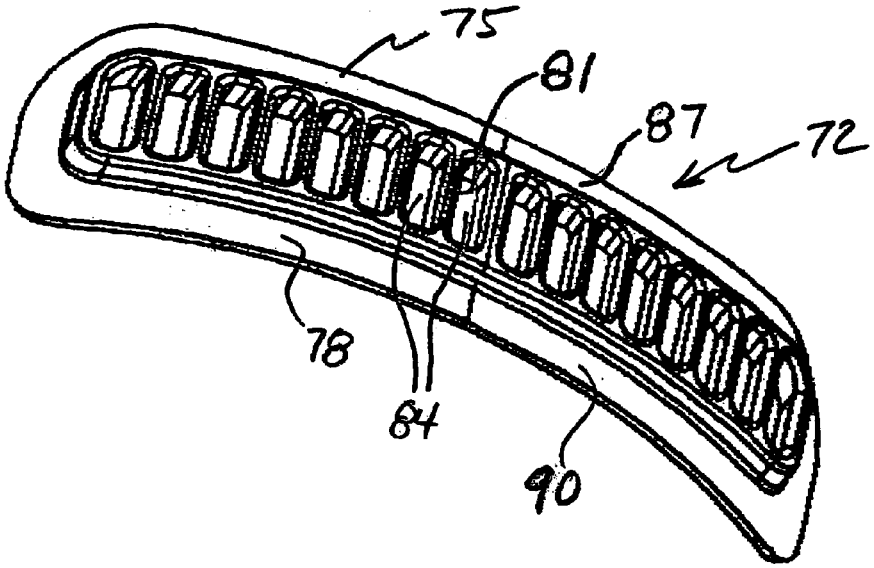

In the embodiments described above, an absorbent material 45 may be provided on the arcuate first side 16. FIG. 13 shows such an absorbent material 45. The absorbent material 45 is intended to reside between the wearer's forehead and the arcuate first side 16 to provide a cushion for the wearer's forehead, and to absorb perspiration from the wearer. An acceptable absorbent material 45 is terry cloth.

The absorbent material 45 may be selectively attached to the arcuate first side 16 by a hook and loop fastener to allow the absorbent material 45 to be removed and either cleaned or replaced with a new piece of absorbent material 45. In such an embodiment, one side of the hook and loop fastener is attached to the arcuate first side 16 and the other side of the hook and loop fastener is attached to the absorbent material 45. Alternatively, if the absorbent material 45 provides loops, as is the case in terry cloth, the hook side 48, shown in FIG. 9, of a hook and loop fastener is attached to the arcuate first side 16 and the absorbent material 45 is attached directly to the hook side 48.

FIGS. 1, 3, 4, and 7 show an optional abutment 51 provided to help maintain the shape of the hat 30. The abutment 51 may be connected to the base 13. The abutment 51 is positioned distal from the lip 25 so as to provide a surface against which the hat 30 will rest. Preferably, the abutment 51 is arcuately shaped.

Figure 14:
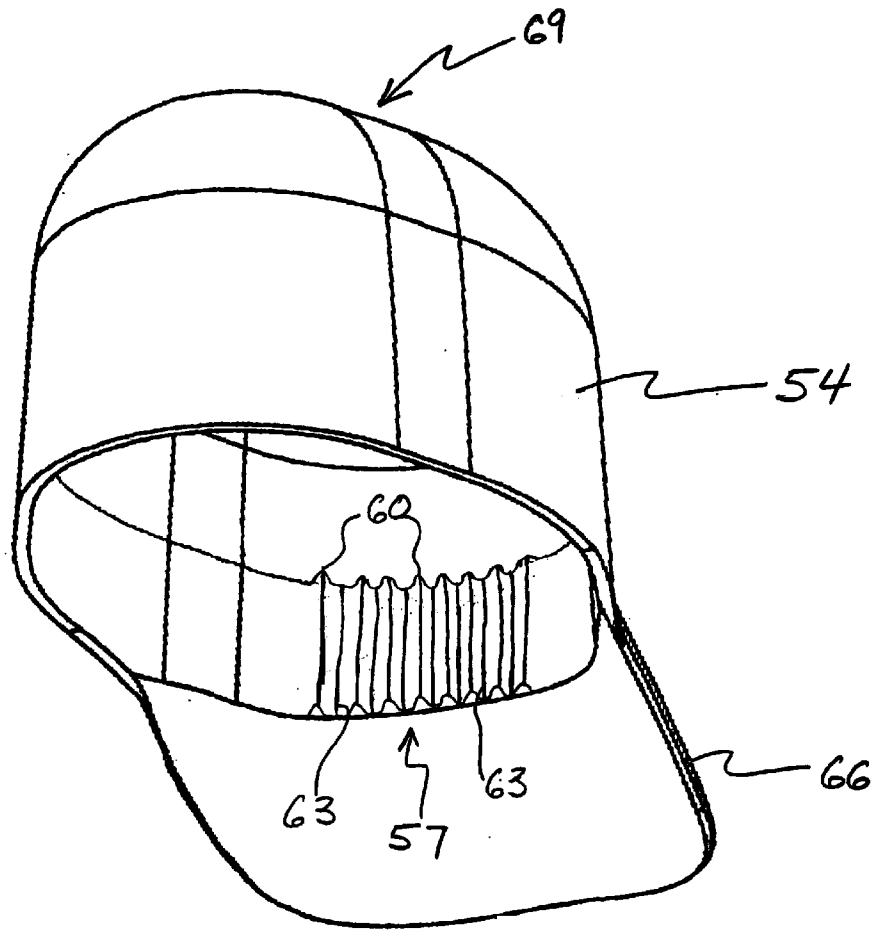
FIG. 14 is a perspective view of another embodiment of the present invention.

FIG. 14 shows another embodiment of the present invention. This embodiment shows a vented hat 54 having a head band 39 with a corrugated surface 57 on the head band 39. The corrugated surface 57 has alternating ridges 60 and grooves 63 oriented to allow air to pass by the head band 39. For example, the ridges 60 and grooves 63 may be oriented to extend from a bill 66 toward the top portion 69 of the hat 30.

Figure 21:
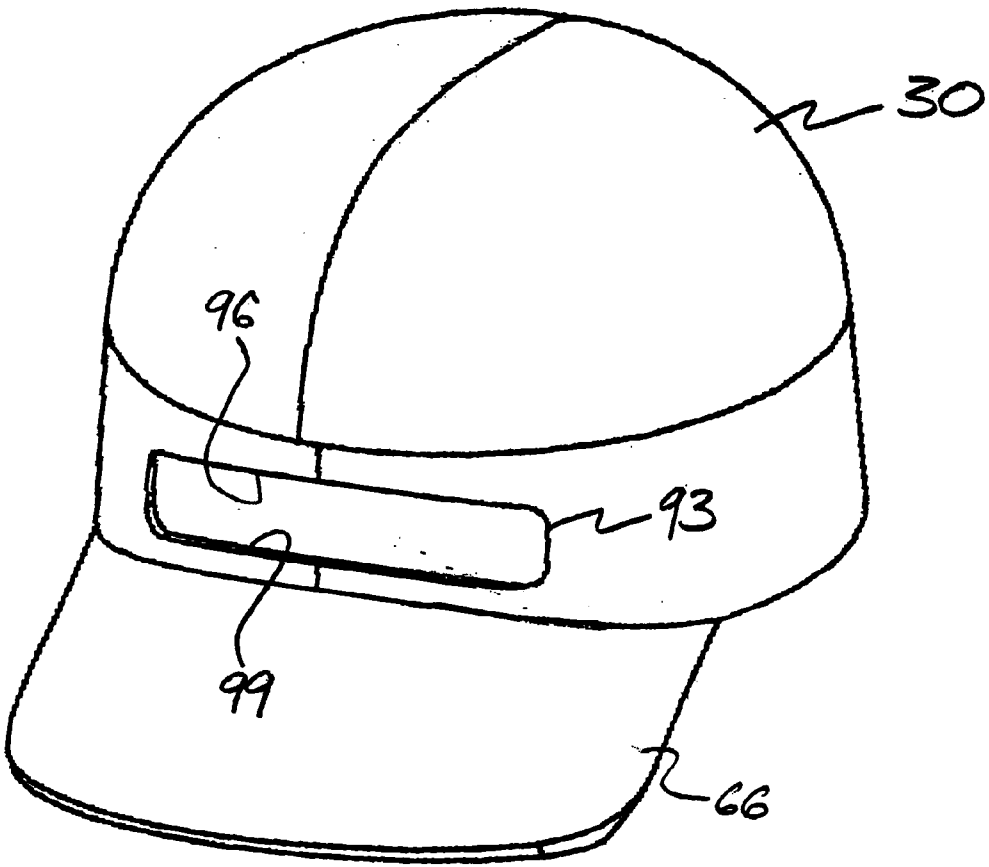
FIG. 21 is a perspective view of the hat shown in FIGS. 15 and 16, without the vent.

FIGS. 15–20 show another embodiment of the present invention, which includes a vent 72 having a first anchoring surface 75 and a second anchoring surface 78. Extending between the first and second anchoring surfaces 75, 78 is a truss 81. Air is permitted to flow around the truss 81 through the orifices 84. Preferably, the first anchoring surface 75 has a first arcuately shaped surface 87 and the second anchoring surface 78 has a second arcuately shaped surface 90. The vent 72 may be inserted into an opening 93 in a hat 30, shown in FIG. 21, to form the vented hat 54 and attached to the hat 30 with an adhesive material. The vent 72 is preferably positioned proximate to the bill 66 of the hat 30 and/or proximate to the wearer's forehead.

Figure 22:
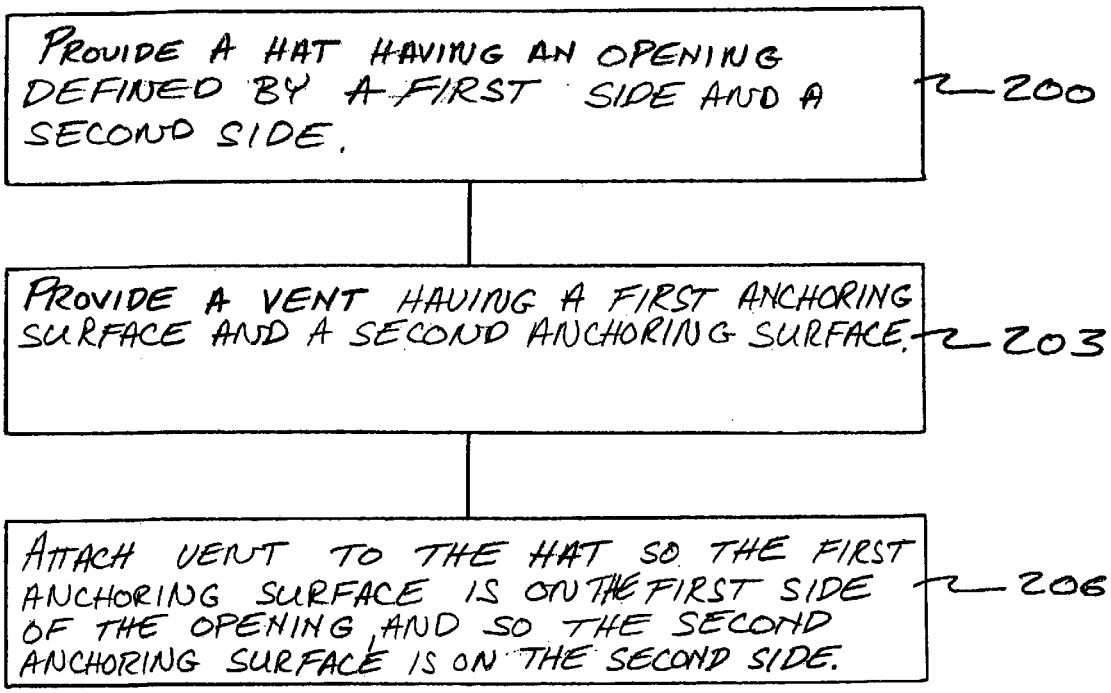
FIG. 22 shows steps of a method according to the present invention.

The present invention also includes a method of making a vented hat. FIG. 22 shows steps of a method according to the present invention. The method begins by providing a hat having an opening defined by a first side 96 and a second side 99 (step 200). Next, a vent is provided (step 203). The vent has a first anchoring surface, a second anchoring surface and a truss extending from the first anchoring surface to the second anchoring surface. Then, the vent is attached to the hat (step 206) so that the first anchoring surface is on the first side 96 of the opening and so that the second anchoring surface is on the second side 99 of the opening.

It should be noted that the present invention described herein may be used in flexible hats, hard hats and helmets. Such head gear may include but is not limited to bicycle helmets, construction helmets, hockey helmets, football helmets, baseball hats and motorcycle helmets.

Although the present invention has been described with respect to one or more particular embodiments, it will be understood that other embodiments of the present invention may be made without departing from the spirit and scope of the present invention. Hence, the present invention is deemed limited only by the appended claims and the reasonable interpretation thereof.

What is claimed is:

1. An air circulation device, comprising:

a hat;

a base having an arcuate first side and a second side, the second side having a rib extending from the second side and oriented to allow air to pass between the hat and a wearer's head; and thread attaching the base to the hat so the arcuate first side faces an inside surface of the hat.

2. The device of claim 1, wherein the base has a lip extending away from the arcuate first side.

3. The device of claim 1, further comprising an abutment connected to the base.

4. The device of claim 3, wherein the abutment is positioned distal from a lip.

5. The device of claim 3, wherein the abutment is arcuately shaped.

6. The device of claim 1 further comprising an absorbent material attached to the arcuate first side.

7. The device of claim 2, further comprising an abutment positioned distal from the lip.

8. The device of claim 1, wherein the base is sewn to a headband of the hat.

* * * * *